US007410226B1

(12) United States Patent
Meskan

(10) Patent No.: US 7,410,226 B1
(45) Date of Patent: Aug. 12, 2008

(54) EXTENSIBLE MONITOR SUPPORT SYSTEM

(75) Inventor: Jeffrey J. Meskan, Scottsdale, AZ (US)

(73) Assignee: Nexus 21, Inc., Scottsdale, AZ (US)

( * ) Notice: Subject to any disclaimer, the term of this patent is extended or adjusted under 35 U.S.C. 154(b) by 122 days.

(21) Appl. No.: 11/438,062

(22) Filed: May 18, 2006

(51) Int. Cl.
*A47B 5/00* (2006.01)

(52) U.S. Cl. ..... 312/7.2; 248/132

(58) Field of Classification Search ..... 248/132, 248/161, 157, 475.1; 108/47; 312/702, 306, 312/312
See application file for complete search history.

(56) References Cited

U.S. PATENT DOCUMENTS

| | | | | |
|---|---|---|---|---|
| 3,761,152 | A * | 9/1973 | Cory | 312/7.2 |
| 3,967,804 | A * | 7/1976 | Kneile | 248/188.2 |
| 4,025,017 | A | 5/1977 | Miller | |
| 4,580,754 | A | 4/1986 | Hughes | |
| 5,961,090 | A * | 10/1999 | Parkin | 248/475.1 |
| 6,073,892 | A * | 6/2000 | Dittmer | 248/157 |
| 6,409,134 | B1 | 6/2002 | Oddsen, Jr. | |
| 6,484,993 | B2 | 11/2002 | Huffman | |
| 6,612,670 | B2 * | 9/2003 | Liu | 312/312 |
| 6,672,560 | B1 | 1/2004 | Hart | |
| 6,726,167 | B2 | 4/2004 | Oddsen, Jr. | |
| 6,848,672 | B2 | 2/2005 | Cross et al. | |
| 6,874,756 | B2 | 4/2005 | Hawkins et al. | |
| 6,902,243 | B2 * | 6/2005 | Bober | 312/306 |
| 7,327,516 | B2 * | 2/2008 | Wheeler | 359/443 |
| 2003/0038222 | A1 * | 2/2003 | Holmes | 248/475.1 |
| 2006/0290248 | A1 * | 12/2006 | Chandler | 312/312 |

* cited by examiner

*Primary Examiner*—Ramon O Ramirez
(74) *Attorney, Agent, or Firm*—Jordan M. Meschkow; Lowell W. Gresham; Charlene R. Jacobsen

(57) ABSTRACT

An extensible monitor support system (20) is provided. The system (20) may include a cabinet (24) made up of a horizontal base (28), a back (30), right and left sides (26), a front (32), and a top (34). Within the cabinet (24) is a lift apparatus (40) made up of an extensible support column (42) formed of telescoping outer, intermediate, and inner sections (44,46, 48), a base plate (50) coupled to the cabinet base (28) and the column outer section (44), a pair of opposing bayonet sheaths (60) coupled to the column outer section (44), a primary coupling component (62) coupled to the bayonet sheaths (60) and the cabinet back (30), and a monitor support bracket (72) coupled to the column inner section (48) and the monitor (22). The monitor support bracket (72) is configured to maintain a monitor (22) substantially parallel to the cabinet back (30).

20 Claims, 4 Drawing Sheets

EXTENSIBLE MONITOR SUPPORT SYSTEM

TECHNICAL FIELD OF THE INVENTION

The present invention relates to the field of monitor supports. More specifically, the present invention relates to the field of extensible monitor support systems.

BACKGROUND OF THE INVENTION

Technology has developed flat-panel monitors of reasonable size. Monitors of 42 inches or greater diagonal size are not uncommon. These monitors may be for use as television receivers, computer monitors, instrumentation monitors, or the like, and may involve the use of liquid-crystal, plasma, or other display technology known in the art. These monitors can be relatively large, fragile, and expensive.

Additionally, paintings, sculptures, and other objets d'art may be presented for display and/or examination. These objets d'art may be fragile and/or expensive, often priceless.

Hereinafter, the term "monitor" includes, but is not limited to, any relatively large, fragile, and/or expensive flat-panel monitor, arrangement, device, objet d'art, or other object that is intended to be observed, displayed, or otherwise viewed.

Often, monitors are desirable in locations where the use of the monitor may not be straightforward. For example, a monitor may be desirable for use in a bedroom. However, the size and arrangement of the bedroom may be such that there is no convenient wall surface upon which the monitor may be hung that would also provide optimal viewing for occupants of the bedroom, i.e., from the bed. A means of positioning the monitor where viewing is optimized from the bed is therefore desirable.

One suitable position for a bedroom monitor would be at the foot of the bed and positioned at a height where the monitor may readily be viewed by viewer(s) either laying down or sitting up in the bed. This is best accomplished by supporting the monitor from a footboard of the bed or another (free-standing) piece of furniture located at the foot of the bed. Alternatively, the monitor may be suspended from the ceiling. Both these positions leave the monitor exposed when not in use, and generally detract from the appearance of the room.

In a living room or similar general-use area, it may be desirable that a monitor be positioned for convenient viewing by a number of individuals simultaneously, such as by a family or a gathering of friends. In this case, the monitor may conveniently be hung on a wall at an appropriate location. Unfortunately, this leaves the monitor prey to accidental damage by children, pets, or others when not in use. This is a problem, inasmuch as such monitors can be both relatively expensive and fragile. Enclosing the monitor within a hutch or other furniture may protect the monitor from damage when not in use, but occupies valuable floor and wall space.

In a business environment, a monitor may be desirable in a conference room for presentations, internet meetings, and the like. To maintain a given corporate image, considerable care and expense may have been expended on the décor of the room. It would not be desirable for that décor to be altered or marred by the presence of the monitor when not in use. Neither would it enhance a corporate image by having to bring the monitor into the conference room whenever it is needed. It would be desirable, therefore, to have the monitor within a credenza or other piece of furniture located against or mounted upon a wall of the room, that blends with the décor, and from which the monitor may rise as desired. Alternatively, a monitor may be mounted in an interstitial space above a ceiling and descend into the conference room when desired.

In a school, museum, gallery, or other institution, a monitor may serve as a television, video, computer display, or objet d'art for educational, instructional, or display purposes. An additional problem of protection of the monitor itself from potential damage may exist in such locales. This can be a serious problem in that, while large-screen monitors can be expensive, the budgets in such institutions are often severely limited. Protection of the monitor is therefore highly desirable. Again, such protection may be provided by configuring the monitor to rise from a cabinet or descend from a ceiling when needed, and remain safely tucked away when not needed.

It may be desirable to have a monitor in an airplane, on board a ship, in a corporate marketing van or bus, or in/on another suitable vehicle. In these cases, the use of the monitor is subject to all of the problems previously discussed. These problems are often exacerbated by the premium value of floor and wall space in such a vehicle. Additionally, vehicular use may necessitate that the monitor be secured against shifts and swaying due to the movement of the airplane, vessel, or vehicle, whether the monitor is in use or not.

All of the problems discussed hereinbefore may be addressed by a suitable extensible monitor support system. The desired system may be configured to incorporate or be incorporated into a cabinet or credenza from which the monitor would extend upward for use. Alternatively, such a system may be incorporated into a ceiling or soffit so as to blend with the décor of a room when not in use and descend into the room for use.

There have been several prior art variations of extensible monitor support systems. All these systems suffer from one or a combination of excessive size, insufficient strength or rigidity, positional difficulties, and/or inconvenience of use.

Another problem manifests itself in a personal-use environment. The cost of large-screen flat-panel or other monitors may preclude an individual or family from purchasing multiple monitors for use in different locations. Also, vacation homes or cabins are often left unoccupied for long periods of time. It is therefore undesirable to leave an expensive monitor in the vacation home or cabin when unoccupied, as this may be construed as an invitation to burglarize. It is highly desirable, therefore, that a monitor be easily relocatable between a primary residence and a vacation home or cabin, with or without an attendant system. None of the several prior art variations of extensible monitor support systems offer ease of portability.

Additionally, extensible monitor support systems are often housed in (or a part of) a cabinet assembly. Desirably, this cabinet assembly should occupy a minimal amount of floor space to avoid cluttering or dominating a room. This minimal floor space often makes mounting the extensible monitor support system within the cabinet an exercise in contortion, or necessitates the use of special tools. This inability to be easily mounted, and dismounted, reduces significantly the flexibility of the system and impacts directly upon its portability.

SUMMARY OF THE INVENTION

Accordingly, it is an advantage of the present invention that an extensible monitor support system is provided.

It is another advantage of the present invention that an extensible monitor support system is provided that occupies a minimum of floor space in a free-standing embodiment.

It is another advantage of the present invention that an extensible monitor support system is provided that allows the monitor to extend either upward or downward for use.

It is another advantage of the present invention that an extensible monitor support system is provided that is supported at multiple points.

It is another advantage of the present invention that an extensible monitor support system is provided that allows easy transport and installation of the system, with monitor affixed, between locations.

The above and other advantages of the present invention are carried out in one form by an extensible support system for a monitor. The system includes a substantially vertical mounting surface, an extensible support column configured to extend vertically substantially parallel to the vertical mounting surface, an engaging bracket coupled to the vertical mounting surface, a receiving component coupled to the extensible support column and configured to gravitationally fasten to the engaging bracket, and a monitor support bracket coupled to the extensible support column and the monitor.

The above and other advantages of the present invention are carried out in another form by an extensible support system for a monitor. The system includes a cabinet made up of a substantially horizontal cabinet base, a cabinet back substantially perpendicularly coupled to the cabinet base, a pair of cabinet sides, wherein each of the sides is substantially perpendicularly coupled to the cabinet base and the cabinet back, a cabinet front substantially perpendicularly coupled to the cabinet base and the pair of cabinet sides; and a lift apparatus made up of an extensible support column coupled to the cabinet base, a receiving component coupled to the extensible support column, an engaging bracket coupled to the cabinet back and configured to gravitationally fasten to the receiving component, a monitor support bracket coupled to the extensible support column and the monitor, and configured to maintain a viewing plane of the monitor substantially parallel to the cabinet back.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
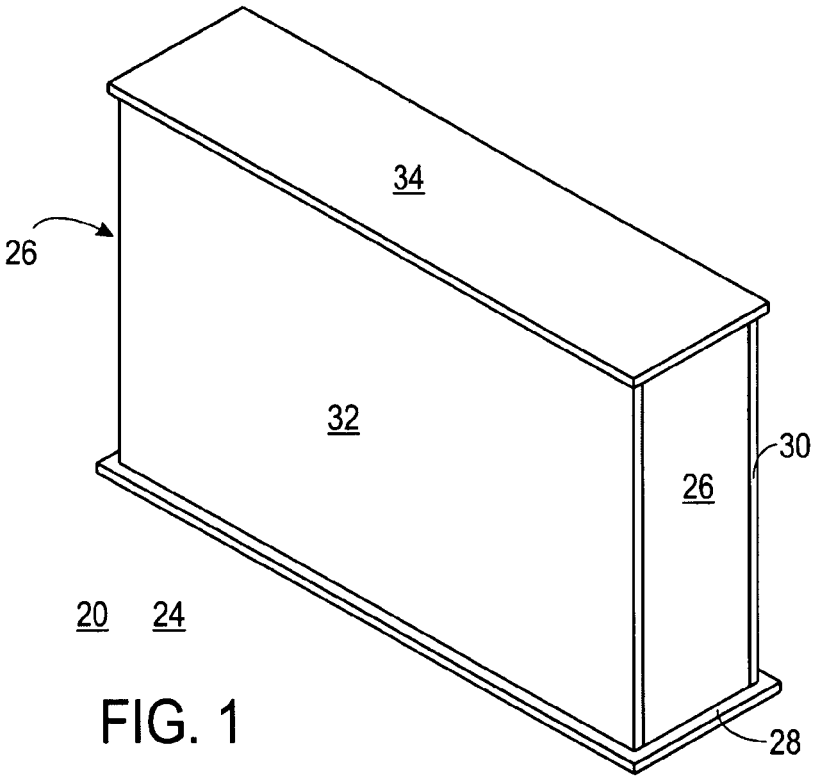
FIG. 1 shows an isometric view of a cabinet containing an extensible monitor support system monitor when the system is retracted in accordance with a preferred embodiment of the present invention.
Figure 2:
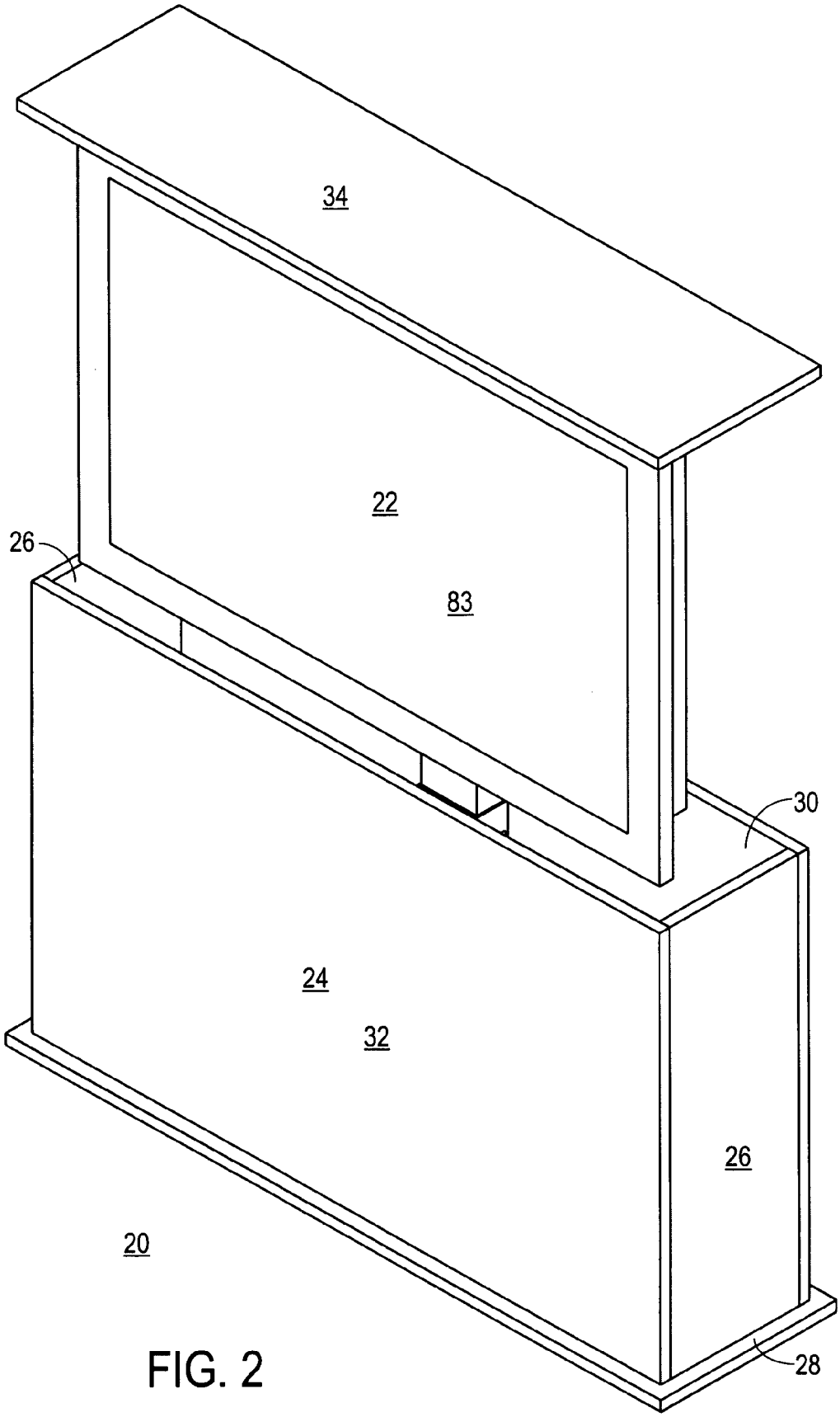
FIG. 2 shows an isometric view of the cabinet of FIG. 1 when the extensible monitor support system is extended in accordance with a preferred embodiment of the present invention.
Figure 3:
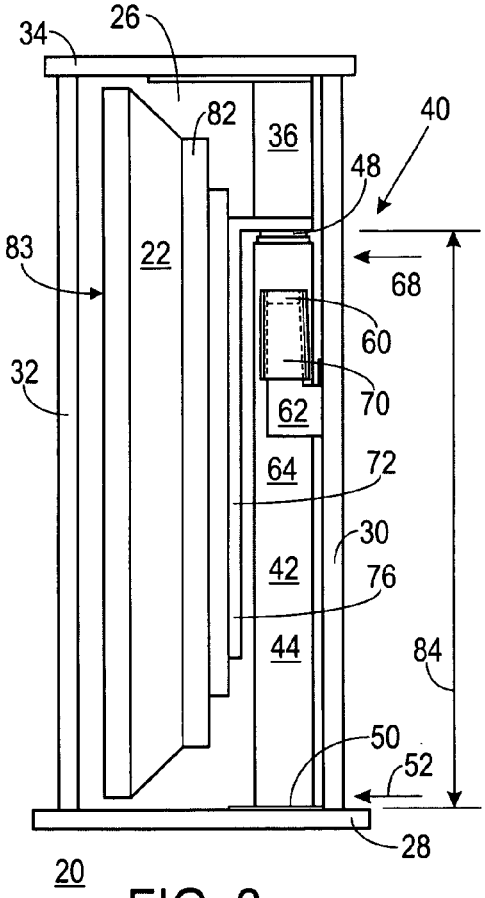
FIG. 3 shows a right side view of the cabinet and the retracted extensible monitor support system of FIG. 1 with a right cabinet side of the cabinet removed in accordance with a preferred embodiment of the present invention.
Figure 4:
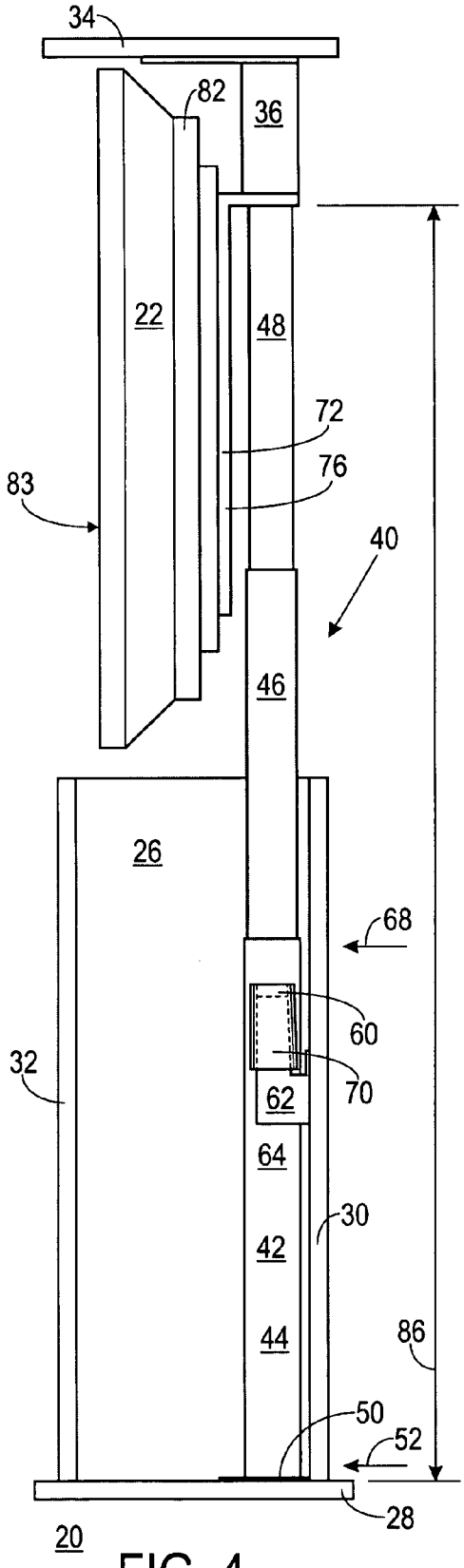
FIG. 4 shows a right side view of the cabinet and extended extensible monitor support system of FIG. 2 with a right cabinet side of the cabinet removed in accordance with a preferred embodiment of the present invention.

In accordance with a preferred embodiment of the present invention, FIGS. 1 and 2 show isometric views and FIGS. 3 and 4 show right side views of an extensible support system 20 for a monitor 22. In FIGS. 1 and 3, monitor 22 is retracted into a cabinet 24. In FIGS. 2 and 4, monitor 22 is extended out of cabinet 24. A side 26 of cabinet 24 has been removed in FIGS. 3 and 4 to show a lift apparatus 40 within cabinet 24. The following discussion refers to FIGS. 1, 2, 3, and 4.

In the preferred embodiment, monitor 22 is a flat-panel monitor, as depicted in the Figures. It will be appreciated, however, that monitor 22 includes, but is not limited to, any relatively large, fragile, and/or expensive flat-panel monitor, objet d'art, or other object or arrangement of object that is intended to be observed, displayed, or otherwise viewed.

Extensible monitor support system 20 includes lift apparatus 40 and mounting surface(s) to which lift apparatus 40 is mounted. In a first preferred embodiment, referred to hereinafter as a cabinet embodiment, lift apparatus 40 is affixed inside a cabinet 24. In this cabinet embodiment the mounting surfaces include a substantially horizontal mounting surface 28 in the form of a base 28 of cabinet 24 and a substantially vertical mounting surface 30 in the form of a back 30 of cabinet 24. Cabinet 24 also includes right and left sides 26, a front 32, and a top 34. As is typical of such cabinets 24, back 30 is substantially perpendicularly coupled to base 28, sides 26 are substantially perpendicularly coupled to horizontal base 28 and back 30, and front 32 is substantially perpendicularly coupled to base 28 and sides 26. Cabinet base 28, back 30, sides 26 and front 32 together form an open-topped box or bin.

Top 34 of cabinet 24 is coupled to back 30, sides 26, and front 32 in any of a number of ways known to those of ordinary skill in the art. As depicted in FIGS. 1, 2, 3, and 4, top 34 is a "floating" top coupled to lift apparatus 40 via a spacer 36. In this embodiment, spacer 36 is proportioned so that top 34 just contacts back 30, sides 26, and front 32 when monitor 22 is fully retracted into cabinet 24.

Those skilled in the art will appreciate that the means of coupling top 34 to the rest of cabinet 24 is not germane to the present invention. Other means of attaching top 34 that will allow lift apparatus 40 to extend and retract monitor 22 out of and into cabinet 24, such as a hinge coupling top 34 to back 30, may be used without departing from the spirit of the present invention.

Lift apparatus 40 is coupled only to base 28 and back 30 (in a manner discussed hereinafter) of cabinet 24. This two-point coupling provides a rigid and stable support for monitor 22. Those skilled in the art will appreciate that cabinet 24 may be reduced to only base 28 and back 30 without affecting the rigidity and stability of the support for monitor 22. That is, "base" 28 may be any horizontal mounting surface 28, such as a floor, and "back" 30 may be any vertical mounting surface 30, such as a wall, where horizontal mounting surface 28 is fixedly positioned proximate vertical mounting surface 30.

Lift apparatus 40 includes an extensible support column 42. Column 42 is in turn made up of at least an outer section 44 and an inner section 48 configured to telescope into outer section 44. In the embodiment of the figures, column 42 also includes an intermediate section 46 configured to telescope between telescoped between outer section 44 and inner section 48. Those skilled in the art will appreciate that the actual number of intermediate sections 46 in extensible support column 42 is not germane to the present invention. Extensible support column 42 may contain any desired number of intermediate sections 46 without departing from the spirit of the present invention. The remainder of this discussion assumes extensible support column 42 is made up of outer section 44, intermediate section 46, and inner section 48.

Outer, intermediate, and inner sections 44, 46, and 48 telescope together. That is, intermediate section 46 is extensibly coupled inside outer section 44, and inner section 48 is extensibly coupled inside intermediate section 46. This allows inner section 48 to retract within and extend without outer section 44.

Figure 5:
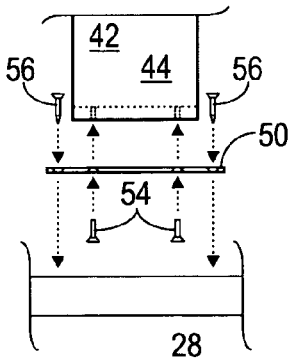
FIG. 5 shows an exploded side view of an interconnection between an extensible support column and a horizontal mounting surface of the system of FIG. 3 through a base plate in accordance with a fixed preferred embodiment of the present invention.
Figure 6:
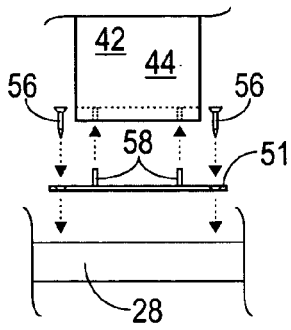
FIG. 6 shows an exploded side view of an extensible support column and a horizontal mounting surface of the extensible monitor support system of FIG. 3 through a base plate in accordance with a removable preferred embodiment of the present invention.

FIGS. 5 and 6 show side exploded views of an interconnection between extensible support column 42 of lift apparatus 40 and horizontal mounting surface 28 through a base plate in accordance with fixed (FIG. 5) and removable (FIG. 6) preferred embodiments of the present invention. The following discussion refers to FIGS. 3, 4, 5, and 6.

Lift apparatus 40 may be fixedly or removably coupled to horizontal mounting surfaces 28, i.e., within cabinet 24. FIG. 5 depicts one way in which lift apparatus 40 may be fixedly coupled to horizontal mounting surface 28. In this "fixed" embodiment, lift apparatus 40 desirably includes a base plate 50. Base plate 50 is coupled between extensible support column 42 and horizontal mounting surface 28. That is, column 42 couples to horizontal mounting surface 28 through base plate 50.

In this fixed embodiment, base plate 50 is attached to a first end 52 of outer section 44 of extensible support column 42 via bolts 54. Outer section 44 and base plate 50 are then attached to horizontal mounting surface 28 via screws 56. This establishes a rigid and stable fixed coupling between lift apparatus 40 and horizontal mounting surface 28.

FIG. 6 depicts one way in which lift apparatus 40 may be removably coupled to horizontal mounting surface 28. In this "removable" embodiment, base plate 50 is replaced with a studded base plate 51. Studded base plate 51 is attached to horizontal mounting surface 28 via screws 56. Studded base plate 51 includes permanent studs 58, which project upward away from horizontal mounting surface 28. First end 52 of column 42 is placed over and removably mates with studs 58. Because of the weight of lift apparatus 40, especially with monitor 22 attached (discussed hereinafter), this establishes a rigid and stable removable coupling between lift apparatus 40 and horizontal mounting surface 28.

The fixed and removable embodiments of the present invention are discussed in further detail hereinafter.

Those skilled in the art will appreciate that the methods of coupling base plate 50 or 51 to extensible support column 42 and horizontal mounting surface 28 demonstrated in FIGS. 5 and 6 are exemplary only. Other coupling methods known in the art may be used without departing from the spirit of the present invention.

Figure 8:
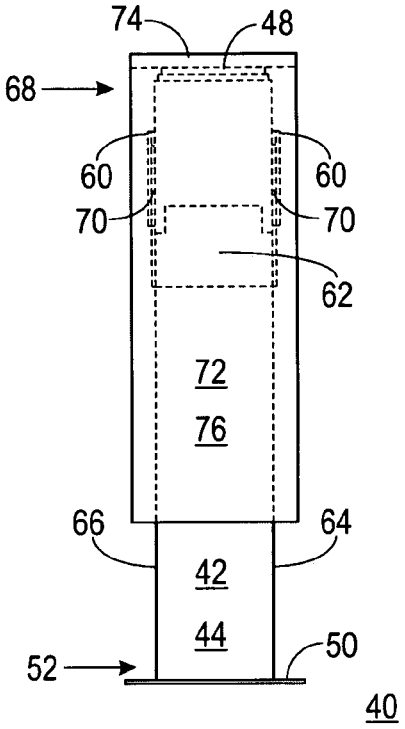
FIG. 8 shows a front view of a lift apparatus of the extensible monitor support system of FIGS. 3 and 4 in accordance with a preferred embodiment of the present invention.
Figure 9:
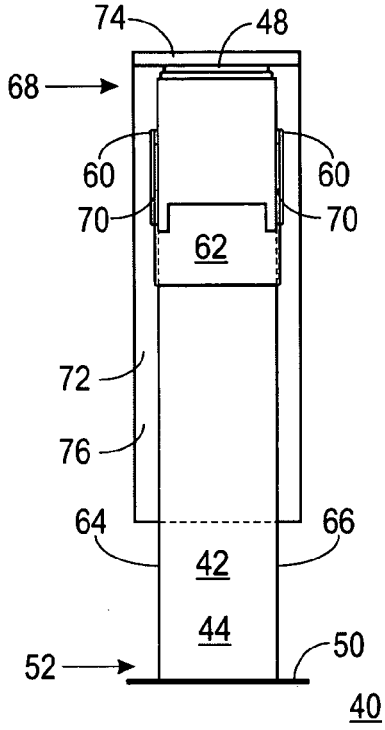
FIG. 9 shows a rear view of the lift apparatus of the extensible monitor support system of FIGS. 3 and 4 in accordance with a preferred embodiment of the present invention.
Figure 7:
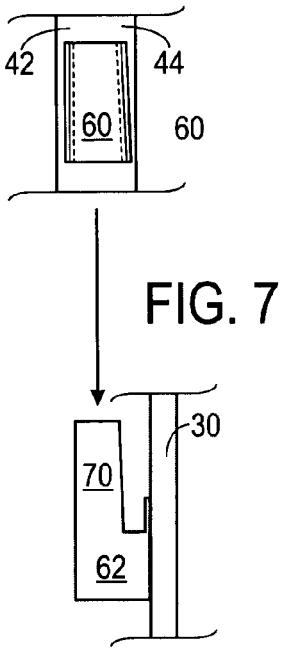
FIG. 7 shows an exploded side view of an interconnection between a receiving component and an engaging component of the extensible monitor support system of FIGS. 3 and 4 in accordance with a preferred embodiment of the present invention.

FIG. 7 shows an exploded side view of an interconnection between a receiving component 60 and an engaging bracket 62 of extensible monitor support system 20 in accordance with a preferred embodiment of the present invention. FIGS. 8 and 9 show front and rear views, respectively, of lift apparatus 40 of system 20 in accordance with a preferred embodiment of the present invention. The following discussion refers to FIGS. 3, 4, 5, 6, 7, 8, and 9.

In the preferred embodiments, a pair of receiving components 60 are fixedly coupled one to each of opposing first and second sides 64 and 66 of outer section 44 of extensible support column 42 proximate a second end 68 of outer section 44. Inasmuch as FIGS. 3, 4, and 7 are side views, only one receiving component 60 coupled to first side 64 of extensible support column 42 is depicted. FIGS. 8 and 9, being front and back views, respectively, depict both receiving components 60 coupled to opposing sides 64 and 66 of extensible support column 42.

Desirably, receiving components 60 are welded to sides 64 and 66 of outer section 44, but those skilled in the art will appreciate that the method of fixedly coupling bayonet sheaths 60 to outer section 44 is not germane. Other methods may be used without departing from the spirit of the present invention.

Engaging bracket 62 is fixedly coupled to vertical support surface (cabinet back) 30 and slidingly coupled to bayonet sheaths 60. Desirably, engaging bracket 62 is fastened to vertical mounting surface 30 by screws (not shown), but those skilled in the art will appreciate that the method of fixedly coupling engaging bracket 62 to vertical mounting surface 30 is not germane. Other methods may be used without departing from the spirit of the present invention.

In the preferred embodiment of the Figures, receiving components 60 are configured as tapered sheaths. Correspondingly, engaging bracket 62 has two tapered tabs 70. Each tab 70 is configured to slide into and firmly engage a sheath 60. Once engaged, receiving components 60, and lift apparatus 40, are rigidly and stably supported by engaging bracket 62 and vertical mounting surface 30.

Desirably, engaging bracket 62 is affixed to vertical mounting surface (cabinet back) 30 before cabinet 24 is assembled. This eliminates the need for an assembler to drive screws in the hard-to-manipulate short front-to-back dimension of cabinet 24.

In the "fixed" embodiment, base plate 50 is attached to extensible support column 42 as discussed hereinbefore (FIG. 5). Lift apparatus 40 is then lowered into cabinet 24, at which time tabs 70 of engaging bracket 62 engage and gravitationally fasten to receiving components 60, as depicted in FIG. 7. Base plate 50 is then fastened to horizontal mounting surface (cabinet base) 28 (FIGS. 3 and 5).

In the "removable" embodiment, studded base plate 51 is affixed to horizontal mounting surface (cabinet base) 28 (FIG. 6), desirably before cabinet 24 is assembled. Lift apparatus 40 is then lowered into cabinet 24, at which time tabs 70 of engaging bracket 62 engage and gravitationally fasten to receiving components 60 (FIG. 7). Substantially simultaneously, studs 58 of studded base plate 51 engage and gravitationally fasten to outer section 44 of extensible support column 42 (FIG. 6). Since lift apparatus 40 is held in place by gravity, especially when monitor 22 is mounted, it may readily be removed from cabinet 24 whenever desired.

In both the fixed and removable embodiments, lift apparatus 40 is rigidly and stably held in place by attachments at both ends 52 and 68 of outer section 44 of extensible support column 42. This is desirable for the security and stability of monitor 22 (discussed hereinafter).

Figure 10:
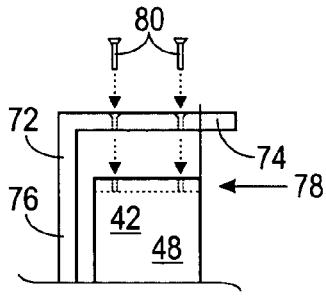
FIG. 10 shows an exploded side view of an interconnection between a monitor support bracket and an extensible support column of the extensible monitor support system in accordance with a preferred embodiment of the present invention.

FIG. 10 shows an exploded side view of an interconnection between a monitor support bracket 72 and extensible support column 42 in accordance with a preferred embodiment of the present invention. The following discussion refers to FIGS. 3, 4, 8, 9, and 10.

Monitor support bracket 72 is made up of a substantially horizontal mounting portion 74 and a substantially vertical monitor support portion 76. Desirably, mounting portion 74 is fixedly coupled to a mounting end 78 of inner section 48 of extensible support column 42 via bolts 80, but those skilled in the art will appreciate that the method of fixedly coupling monitor support bracket 72 to extensible support column 42 is not germane. Other methods may be used without departing from the spirit of the present invention.

Monitor 22 is coupled to monitor support portion 76 of monitor support bracket 72. Depending upon the size and mounting configuration of monitor 22, a monitor interface panel 82, essentially a flat panel simulating the wall upon which monitor 22 is designed to mount, may be required. Panel 82 is coupled to monitor support portion 76 of monitor support bracket 72, desirably by screws or bolts (not shown), and monitor 22 is then mounted to panel 82 in a manner appropriate to that specific monitor 22. Those skilled in the art will appreciate that the use of monitor interface panel 82 is not germane. Other methods of attaching monitor 22 to monitor support bracket may be used without departing from the spirit of the present invention.

The following discussion refers to FIGS. 1, 2, 3, and 4.

Extensible monitor support system 20 is coupled to substantially vertical mounting surface 30. Extensible support column 42 is mounted so that it extends substantially vertically, i.e., substantially parallel to vertical mounting surface 30. This positioning results in support portion 76 of monitor support bracket 72 also being substantially vertical and parallel to vertical mounting surface 30.

When monitor 22 is mounted to monitor support bracket 72, a viewing plane 83 of monitor 22, realized as the face or viewing surface of monitor 22 in the Figures, is substantially vertical and parallel to vertical mounting surface 30, and remains so as extensible support column is extended and retracted.

Extensible support column 42 has a retracted (minimum) length 84 and an extended (maximum) length 86. Retracted length 84 is the length of column 42 when inner section 48 is maximally retracted within outer section 44. When used with cabinet 24, monitor 22 is supported completely inside cabinet 24 when extensible support column 42 is minimally extended (maximally retracted), i.e., the length of column 42 is retracted length 84.

Extended length 86 is the length of column 42 when inner section 48 is maximally extended without outer section 44. When used with cabinet 24, monitor 22 is supported completely outside cabinet 24 when extensible support column 42 is maximally extended, i.e., the length of column 42 is extended length 86.

The means by which extensible support column 42 is extended and retracted is not germane to the present invention. In the preferred embodiments, extensible support column contains or is coupled with an electric motor (not shown) which is configured to extend and/or retract inner section 48 relative to outer section 46 via a screw, chain, belt, or other common drive mechanism. The use of this or other means well-known in the art may be used without departing from the spirit of the present invention.

Figure 11:
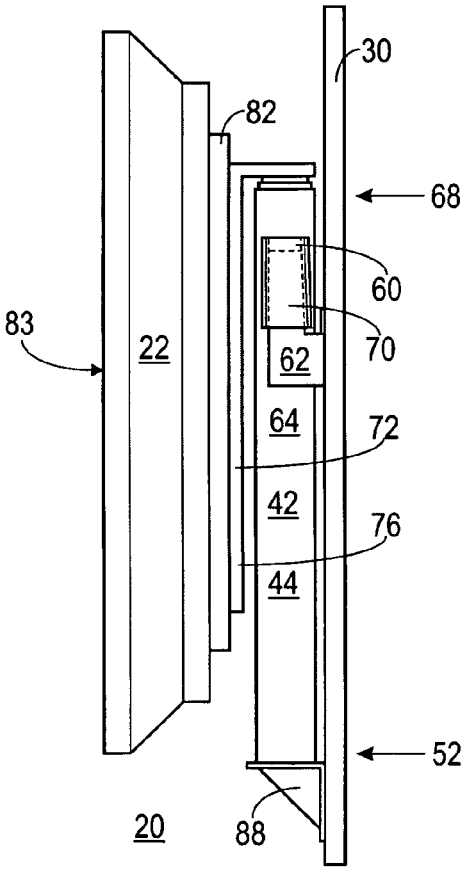
FIG. 11 shows a side view of an alternative embodiment of the extensible monitor support system of FIG. 1.
Figure 12:
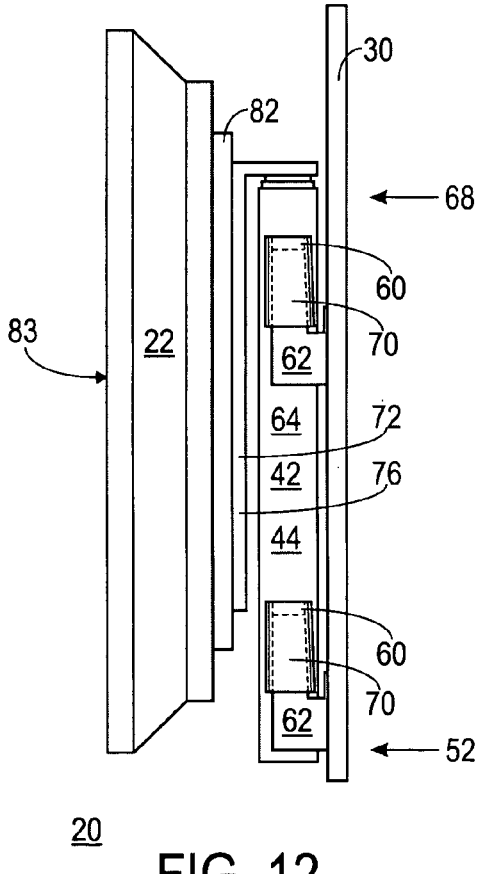
FIG. 12 shows a side view of another alternative embodiment of the extensible monitor support system of FIG. 1.

FIGS. 11 and 12 show side views of alternative embodiments of extensible monitor support system 20. The following discussion refers to FIGS. 3, 4, 11 and 12.

In both the "fixed" and "removable" embodiments discussed hereinbefore, lift apparatus 40 is coupled to vertical mounting surface 30, and is coupled to and rests upon horizontal mounting surface 28. Horizontal and vertical mounting surfaces are embodied in cabinet 24 as base 28 and back 30, respectively.

There may be circumstances, however, in which it is impractical or undesirable to have horizontal mounting surface 28 supporting the weight of lift apparatus 40 and monitor 22, for example, when system 20 is configured for use in a soffit or ceiling and monitor descends into view (rather than rises). FIGS. 11 and 12 demonstrate alternative embodiments of system 20 that have no horizontal mounting surface 28.

In the embodiment of FIG. 11, base plate 50 is replaced by base support bracket 88. Base support bracket is attached to vertical mounting surface 30 via screws (not shown). Base support bracket 88 is also attached to first end 52 of outer section 44 of extensible support column 42 in a manner similar to base plate 50, i.e., via bolts 54 (FIG. 5), for a "fixed embodiment, or similar to studded base plate 51, i.e., via studs 58 (FIG. 6), for a "removable" embodiment. Base support bracket is attached to vertical mounting surface 30 via screws (not shown).

In the embodiment of FIG. 12, bayonet sheaths 60 are also fixedly coupled to opposing first and second sides 64 and 66 of outer section 44 of extensible support column 42 proximate first end 68 of outer section 44. Another bayonet bracket 62 is fixedly coupled to vertical support surface 30 and slidingly coupled to the added bayonet sheaths 60. This is a "removable" embodiment by nature. Lift apparatus 40, with monitor 22 attached, may be easily slid onto and off of bayonet brackets 62.

In summary, the present invention teaches an extensible monitor support system 20 for a monitor 22. System 20 may be configured in a cabinet 24 for free-standing use. Monitor 22 may be retracted completely into cabinet 24 or other enclosure for protection when not in use, and extended completely out of cabinet 24 for viewing. When retracted into cabinet 24 or other enclosure, monitor 22 is concealed and has no impact upon décor. System 20 may be configured to allow monitor to either ascend or descend for viewing, as desired. System 20 incorporated an extensible support column 42 having an outer section 44 that is rigidly and stably supported substantially at both ends 52 and 68, thereby providing stability for monitor 22. System 20 may also be configured to allow easy and rapid removal and insertion of monitor 22 with the lift apparatus 40 of system 20 attached, thereby providing ease of transport between locations.

Although the preferred embodiments of the invention have been illustrated and described in detail, it will be readily apparent to those skilled in the art that various modifications may be made therein without departing from the spirit of the invention or from the scope of the appended claims.

What is claimed is:

1. An extensible support system for a monitor, said system comprising:

a substantially vertical mounting surface;

an extensible support column configured to extend vertically substantially parallel to said vertical mounting surface;

an engaging bracket coupled to said vertical mounting surface;

a receiving component sheath coupled to said extensible support column and configured to gravitationally fasten to said engaging bracket; and a monitor support bracket coupled to said extensible support column and said monitor.

2. A system as claimed in claim 1 wherein said engaging bracket comprises a tab configured to slidingly couple into said receiving component.

3. A system as claimed 1 wherein:

said extensible support column comprises:

an outer section; and an inner section extensibly coupled within said outer section;

said receiving component is fixedly coupled to said outer section; and said monitor support bracket is fixedly coupled to said inner section.

4. A system as claimed in claim 3 wherein said monitor support bracket is fixedly coupled to an end of said inner section.

5. A system as claimed in claim 1 additionally comprising a substantially horizontal mounting surface fixedly positioned proximate said vertical mounting surface and coupled to said extensible support column.

6. A system as claimed in claim 5 additionally comprising a base plate coupled between said horizontal mounting surface and said extensible support column.

7. A system as claimed in claim 1 additionally comprising a base support bracket coupled between said vertical mounting surface and an end of said extensible support column.

8. A system as claimed in claim 1 wherein:

said extensible support column comprises a first side and a second side in opposition to said first side;

said receiving component is a first receiving component fixedly coupled to said extensible support column upon said first side;

said system additionally comprises a second receiving component fixedly coupled to said second side in opposition to said first receiving component; and said engaging bracket is configured to gravitationally fasten to said first and second receiving components.

9. A system as claimed in claim 8 wherein said engaging bracket comprises:

a first tab configured to slidingly engage and gravitationally fasten to said first receiving component; and a second tab configured to slidingly engage and gravitationally fasten to said second receiving component.

10. A system as claimed in claim 1 wherein:

said receiving component is a first receiving component;

said engaging bracket is a first engaging bracket coupled to said first receiving component; and said system additionally comprises:

a second receiving component coupled to said extensible support column; and a second engaging bracket coupled to said second receiving component and said vertical mounting surface.

11. A system as claimed in claim 10 wherein:

said extensible support column comprises an outer section comprising:

a first end;

a second end;

a first side; and a second side in opposition to said first side;

said first receiving component is fixedly coupled to said first side proximate said first end; and said second receiving component is fixedly coupled to one of said first side and said second side proximate said second end.

12. A system as claimed in claim 10 wherein:

said extensible support column comprises an outer section comprising:

a first end;

a second end;

a first side; and a second side in opposition to said first side;

said first receiving component is fixedly coupled to said first side proximate said first end;

said second receiving component is fixedly coupled to said first side proximate said second end;

said system additionally comprises:

a third receiving component fixedly coupled to said second side proximate said first end and in opposition to said first receiving component; and a fourth receiving component fixedly coupled to said second side proximate said second end and in opposition to said second receiving component;

said first engaging bracket is coupled to said first and third receiving components; and said second engaging bracket is coupled to said second and fourth receiving components.

13. A system as claimed in claim 1 wherein said monitor support bracket is configured to maintain a viewing plane of said monitor substantially parallel to said vertical mounting surface.

14. An extensible support system for a monitor, said system comprising:

a cabinet comprising:

a substantially horizontal cabinet base;

a cabinet back substantially perpendicularly coupled to said cabinet base;

a pair of cabinet sides, wherein each of said sides is substantially perpendicularly coupled to said cabinet base and said cabinet back; and a cabinet front substantially perpendicularly coupled to said cabinet base and said pair of cabinet sides; and a lift apparatus comprising:

an extensible support column coupled to said cabinet base;

a receiving component coupled to said extensible support column;

an engaging bracket coupled to said cabinet back and configured to gravitationally fasten to said receiving component; and a monitor support bracket coupled to said extensible support column and said monitor, and configured to maintain a viewing plane of said monitor substantially parallel to said cabinet back.

15. A system as claimed in claim 14 wherein said lift apparatus additionally comprises a base plate coupled between said cabinet base and said extensible support column.

16. A system as claimed in claim 14 wherein:

said extensible support column comprises an outer section comprising:

a first end; and a second end;

said receiving component is a first receiving component coupled to said outer section proximate said first end;

said engaging bracket is a first engaging bracket fixedly coupled to said cabinet back and configured to removably engage with and gravitationally fasten to said first receiving component; and said lift apparatus additionally comprises:

a second receiving component coupled to said outer section proximate said second end; and a second engaging bracket fixedly coupled to said cabinet back and configured to removably engage with and gravitationally fasten to said second receiving component.

17. A system as claimed in claim 16 wherein:

said outer section additionally comprises:

a first side; and a second side in opposition to said first side;

said first receiving component is fixedly coupled to said first side;

said second receiving component is fixedly coupled to said first side;

said system additionally comprises:

a third receiving component fixedly coupled to said second side in opposition to said first receiving component; and a fourth receiving component fixedly coupled to said second side in opposition to said second receiving component;

said first engaging bracket is configured to removably engage with and gravitationally fasten to said first and third receiving components; and said second engaging bracket is configured to removably engage with and gravitationally fasten to said second and fourth receiving components.

18. A system as claimed 14 wherein:

said extensible support column comprises:

an outer section; and an inner section extensibly coupled to and configured to retract within and extend without said outer section;

when said inner section is maximally retracted within said outer section, said monitor is supported completely inside said cabinet; and when said inner section is maximally extended without said outer section, said monitor is supported completely outside said cabinet.

19. A system as claimed in claim 14 wherein:

said extensible support column comprises:

an outer section; and an inner section extensibly coupled to said outer section;

said receiving component is coupled to said outer section; and said monitor support bracket is coupled to said inner section.

20. An extensible support system for a monitor, said system comprising:

a substantially horizontal cabinet base;

a cabinet back substantially perpendicularly coupled to said cabinet base;

a pair of cabinet sides, wherein each of said cabinet sides is substantially perpendicularly coupled to said cabinet base and said cabinet back;

a cabinet front substantially perpendicularly coupled to said cabinet base and said pair of second cabinet sides;

a base plate coupled to said cabinet base;

an extensible support column coupled to said base plate and comprising:

an outer section; and an inner section extensibly coupled within said outer section;

a first receiving component fixedly coupled to said outer section;

a second receiving component fixedly coupled to said outer section in opposition to said first receiving component;

an engaging bracket fixedly coupled to said cabinet back and configured to gravitationally fasten to said first and second receiving components; and a monitor support bracket coupled to said inner section and said monitor, and configured to maintain a viewing plane of said monitor substantially parallel to said cabinet back.

* * * * *